US008893681B2

(12) United States Patent
Sakata

(10) Patent No.: US 8,893,681 B2
(45) Date of Patent: Nov. 25, 2014

(54) PRESSURE SUPPORT FOR ENGINE VALVE STEM SEALS

(71) Applicant: Freudenberg-NOK General Partnership, Plymouth, MI (US)

(72) Inventor: David Sakata, Livonia, MI (US)

(73) Assignee: Freudenberg-NOK General Partnership, Plymouth, MI (US)

( * ) Notice: Subject to any disclaimer, the term of this patent is extended or adjusted under 35 U.S.C. 154(b) by 0 days.

(21) Appl. No.: 13/788,659

(22) Filed: Mar. 7, 2013

(65) Prior Publication Data

US 2014/0251253 A1 Sep. 11, 2014

(51) Int. Cl.
*F01L 3/00* (2006.01)
*F01L 3/08* (2006.01)

(52) U.S. Cl.
CPC ..... *F01L 3/08* (2013.01)
USPC ..... 123/188.6; 123/188.1; 277/502

(58) Field of Classification Search
CPC ..... F01L 3/08; F01L 2101/00; F01L 2810/02
USPC ..... 123/188.6, 188.1, 188.5, 188.3, 190.17; 277/502, 572
See application file for complete search history.

(56) References Cited

U.S. PATENT DOCUMENTS

| | | | | |
|---|---|---|---|---|
| 3,443,845 | A * | 5/1969 | Walchle et al. | 384/16 |
| 4,317,436 | A | 3/1982 | Barnhart et al. | |
| 4,947,811 | A * | 8/1990 | Binford | 123/188.6 |
| 5,110,142 | A | 5/1992 | Szott | |
| 5,553,869 | A * | 9/1996 | Stamback | 277/502 |
| 5,558,056 | A * | 9/1996 | Sakata | 123/188.6 |
| 5,775,284 | A * | 7/1998 | Kirchner et al. | 123/188.6 |
| 6,026,771 | A * | 2/2000 | Escobosa | 123/90.12 |
| 6,270,082 | B1 | 8/2001 | Hegemier | |
| 6,318,328 | B1 | 11/2001 | Hegemier | |
| 6,761,141 | B2 | 7/2004 | Leimer | |
| 6,764,079 | B1 | 7/2004 | Hegemier et al. | |
| 8,011,669 | B2 | 9/2011 | Sakata et al. | |
| 8,235,394 | B2 | 8/2012 | Sakata | |
| 2002/0171205 | A1* | 11/2002 | Leimer | 277/502 |
| 2003/0160394 | A1* | 8/2003 | Martelli | 277/500 |
| 2005/0001196 | A1 | 1/2005 | McArthy et al. | |
| 2010/0295252 | A1* | 11/2010 | Pawl et al. | 277/502 |

FOREIGN PATENT DOCUMENTS

| | | |
|---|---|---|
| EP | 0392893 A1 | 10/1990 |
| EP | 2112337 A1 | 10/2009 |

* cited by examiner

*Primary Examiner* — Noah Kamen
*Assistant Examiner* — Long T Tran
(74) *Attorney, Agent, or Firm* — Daniel J. Sepanik, Esq.; Harness, Dickey & Pierce, P.L.C.

(57) ABSTRACT

A valve stem seal assembly for an internal combustion engine includes an annular rigid case disposed around a valve guide and a valve stem. An annular elastomeric body is press fit within the annular rigid case and including a radially inwardly extending seal lip in sealing contact with the valve stem. The annular elastomeric body includes a first axial end facing the valve guide and a second axial end facing away from the valve guide. The annular rigid case includes a radially inwardly extending end wall opposing the second axial end of the annular elastomeric body and including a lip support extending axially from an inner portion of the radially inwardly extending end wall and opposing a radially inner surface of the radially inwardly extending seal lip.

16 Claims, 3 Drawing Sheets

PRESSURE SUPPORT FOR ENGINE VALVE STEM SEALS

FIELD

The present disclosure relates to valve stem seals for internal combustion engines and more particularly, to a valve stem seal having a pressure support for preventing the seal from becoming inverted.

BACKGROUND

This section provides background information related to the present disclosure which is not necessarily prior art.

Internal combustion engines are known to employ valve stem seals to regulate oil to the valve guide and minimize oil from entering a combustion chamber. However, the weakness of the current art is that pressure from the combustion chamber and an exhaust port of an engine can affect the function of primary sealing lips of valve stem seals. Gas lips, which provide an additional seal, have been applied, but pressure acting on such a gas lip can cause the orientation of a primary sealing lip against a valve stem to change and result in improper function. Accordingly, it would be desirable to provide a valve stem seal that can withstand high pressures while continuing to prevent excessive oil from entering the combustion chamber.

SUMMARY

This section provides a general summary of the disclosure, and is not a comprehensive disclosure of its full scope or all of its features.

A valve stem seal assembly for an internal combustion engine includes an annular rigid case disposed around a valve guide and a valve stem. An annular elastomeric body is press fit within the annular rigid case and including a radially inwardly extending seal lip in sealing contact with the valve stem. The annular elastomeric body includes a first axial end facing the valve guide and a second axial end facing away from the valve guide. The annular rigid case includes a radially inwardly extending end wall opposing the second axial end of the annular elastomeric body and including a lip support extending axially from an inner portion of the radially inwardly extending end wall and opposing a radially inner surface of the radially inwardly extending seal lip.

According to an alternative aspect of the present disclosure, an annular lip support member is disposed between the radially inwardly extending end wall of the annular rigid case and the second axial end of the annular elastomeric body, the annular lip support member opposing a radially inner surface of the radially inwardly extending seal lip.

By inserting the annular elastomeric body into the annular rigid case, rather than molding the annular elastomeric body therein, the lip is free to move radially to adjust to the stem movement without being restricted by being directly bonded to the annular rigid case or the back-up support member.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
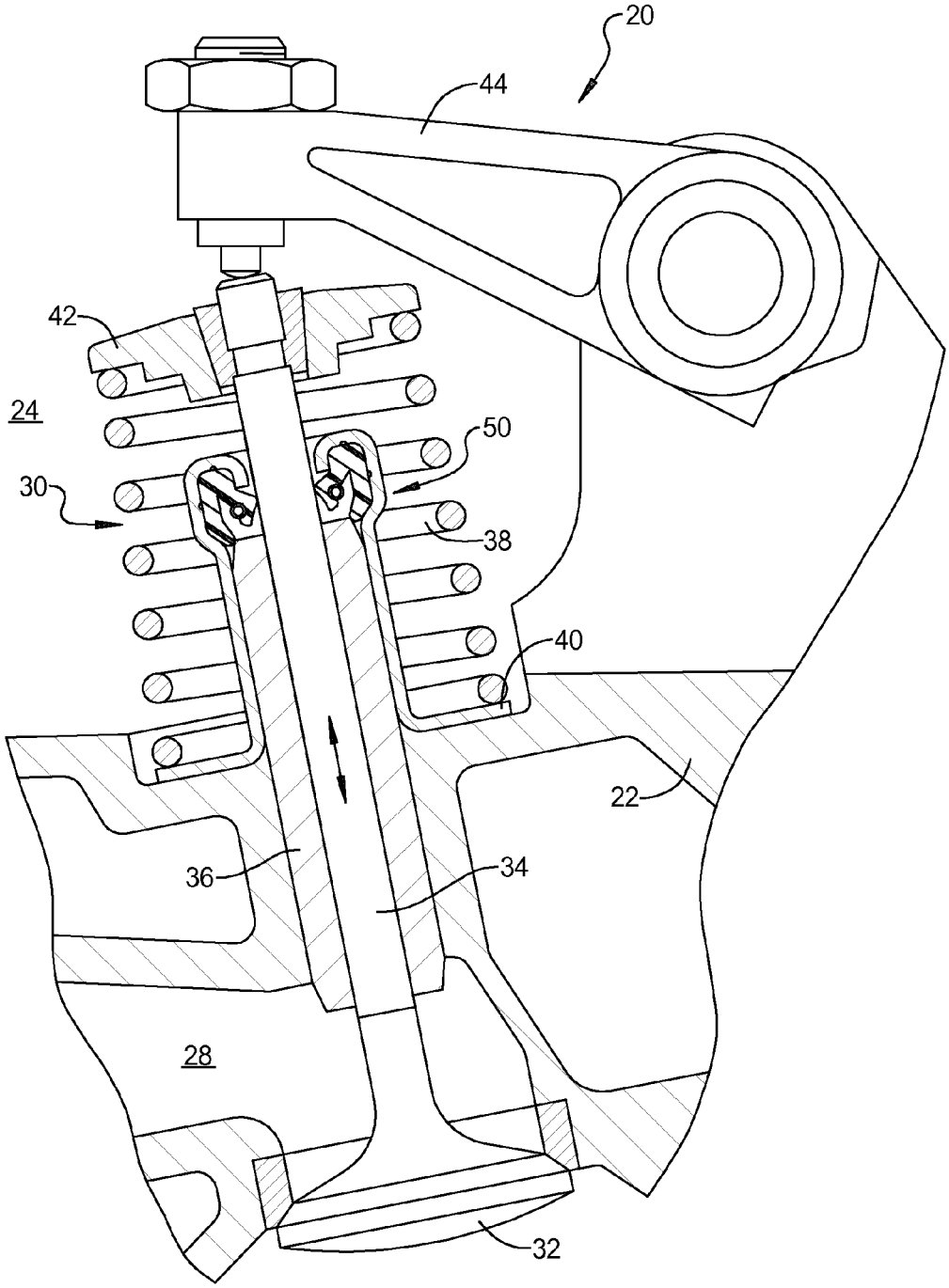
FIG. 1 is a cross-sectional view of a portion of an internal combustion engine including a valve stem seal assembly according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Referring to FIG. 1, a portion of an engine 20 is shown. According to the principles of the present disclosure, engine 20 can be an internal combustion engine and can have a variety of forms and configurations, including but not limited to an overhead valve configuration and overhead camshaft configuration. Engine 20 can have a variety of components including a housing 22. Housing 22 can define a lubrication or oil chamber 24 and a combustion chamber 26. Housing 22 can further define an inlet or exhaust chamber 28 for combustion chamber 26. It should be understood that further reference to inlet chamber 28 herein as "inlet" should also be considered as equally pertaining to the exhaust chamber as well. Engine 20 can further include a valve assembly 30 disposed between oil chamber 24 and combustion chamber 26. As the general function and operation of engine 20 and the components thereof are well known to those of ordinary skill in the art, they will not be further described herein.

Valve assembly 30 can have a variety of components. Valve assembly 30 can include a valve head 32 disposed within combustion chamber 26. Valve head 32 can be connected to a valve stem 34, which can be disposed within a valve guide 36. Valve stem 34 and valve guide 36 can extend through housing 22 between oil chamber 24 and combustion chamber 26. Valve assembly 30 can further include a valve spring 38 within oil chamber 24. Valve spring 38 can be disposed between a valve spring seat 40 and a valve spring retainer 42. Valve spring seat 40 can be coupled to housing 22, and valve spring retainer can be coupled to valve stem 34. Valve assembly 30 can further include an actuation mechanism 44 disposed within oil chamber 24. Actuation mechanism 44 can vary according to the form of engine 20. Additionally, valve assembly 30 can include a valve stem seal assembly 50 disposed around valve stem 34 and valve guide 36 within oil chamber 24.

Valve assembly 30 can be selectively operable to control fluid communication between combustion chamber 26 and inlet chamber 28. In particular, valve head 32 can be positioned to close combustion chamber 26 to fluid communication with inlet chamber 28 or to open combustion chamber 26 to fluid communication with inlet chamber 28. The position of valve head 32 can correspond to the position of valve stem 34. Valve guide 36 can be coupled to housing 22, and valve stem 34 can be operable to move in an axial direction relative to valve guide 36. Valve spring 38 can bias valve stem 34 and valve head 32 into a home position. As shown in FIG. 1, the home position can correspond to valve head 32 closing combustion chamber 26 to fluid communication with inlet chamber 28. Furthermore, actuation mechanism 44 can be selectively operated to move valve stem 34 and valve head 32 from the home position and thereby open combustion chamber 26 to fluid communication with inlet chamber 28. During operation of valve assembly 30, valve stem seal assembly 50 can provide a seal around valve stem 34 and valve guide 36 and can regulate oil and/or other fluids from oil chamber 24 from entering combustion chamber 26.

During operation of engine 20, excess exhaust gases can build up in combustion chamber 26 or back flow from chamber 28. These excess exhaust gases can travel between valve guide 36 and valve stem 34 and can exert pressure on valve stem seal assembly 50. According to the principles of the present disclosure, valve stem seal assembly 50 can include an annular rigid case 52 disposed around the valve guide 36 and the valve stem 34. The valve spring seat 40 can optionally be formed integrally with the annular rigid case 52. An annular elastomeric body 54 is press fit or otherwise inserted within the annular rigid case 52.

Figure 2:
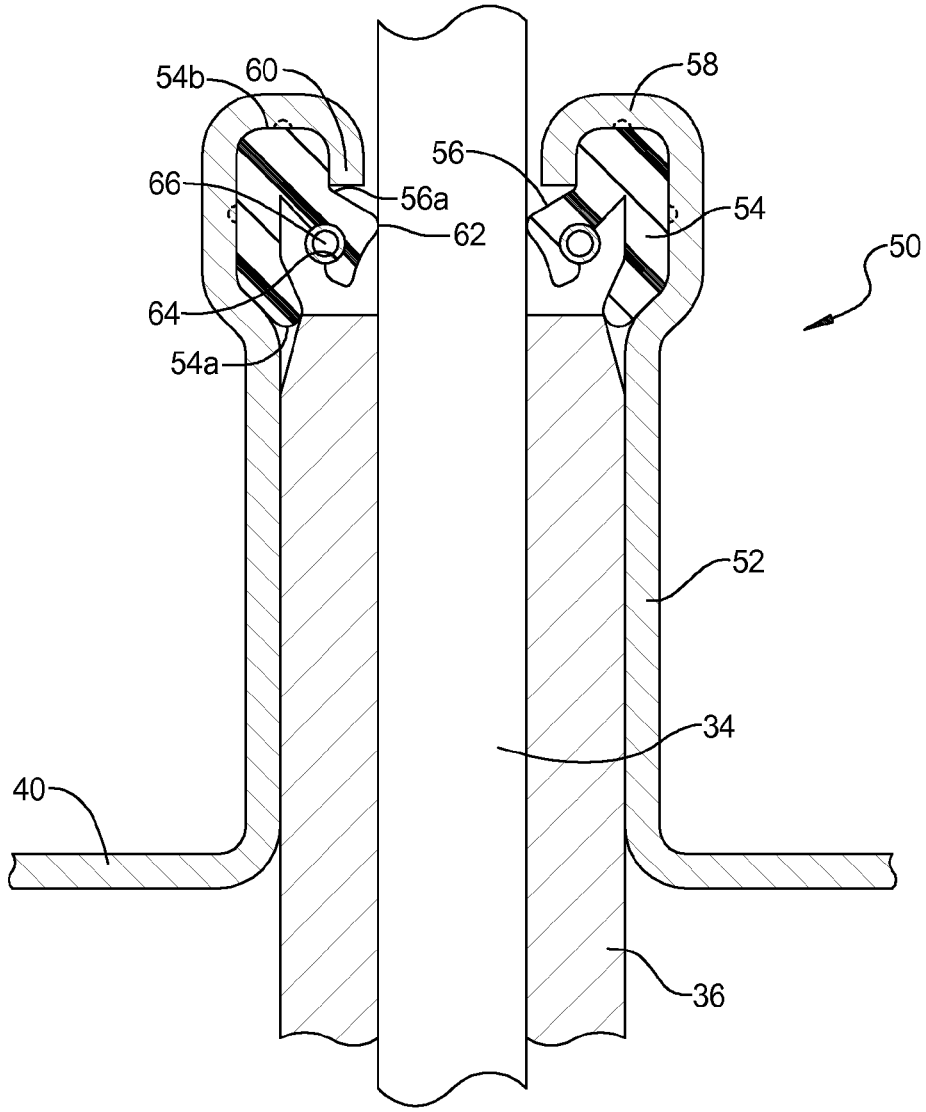
FIG. 2 is a cross-sectional view of a valve stem seal assembly according to the principles of the present disclosure.

With reference to FIG. 2, the annular elastomeric body 54 includes a radially inwardly extending seal lip 56 in sealing contact with the valve stem 34. The annular elastomeric body 54 has a first axial end 54*a* that can engage the valve guide 36 and a second axial end 54*b* facing away from the valve guide 36. The engagement of the first axial end 54*a* with the valve guide 36 will prevent oil from flowing between the seal case inner diameter and the outer diameter of the valve guide 36.

The annular rigid case 52 includes a radially inwardly extending end wall 58 opposing the second axial end 54*b* of the annular elastomeric body 54. The annular rigid case 52 includes a lip support portion 60 extending axially from an inner portion of the radially inwardly extending end wall 58 and opposes a radially inner surface 56*a* of the radially inwardly extending seal lip 56. The lip support portion 60 prevents the seal lip 56 from being inverted when exposed to high pressures from the combustion side of the valve guide 36. By inserting the annular elastomeric body 54 into the annular rigid case, the seal lip 56 is free to move radially to adjust to the stem 34 movement without being restricted by being directly bonded to the annular rigid case.

The annular rigid case 52 can be made from metal or other rigid material. The case 52 can be stepped radially outward, as shown, to accommodate the seal body 54 therein. Alternatively, the case can be flush with or stepped inward relative to the valve guide 36. The annular elastomeric body 54 can be made from rubber or other elastomeric material. The radially inwardly extending seal lip 56 of the annular elastomeric body 54 includes a contact surface 62 for engaging the valve stem 34 and can include a recessed groove 64 disposed on an opposite side of the contact surface 62 for receiving an annular spring member 66 therein to apply a constant tension on the valve stem 34. The radially inwardly extending seal lip 56 can extend axially from the second axial end 54*b* of the annular elastomeric body 54 so that the contact surface 62 of the seal lip can be axially spaced from the lip support portion 60.

Figure 3:
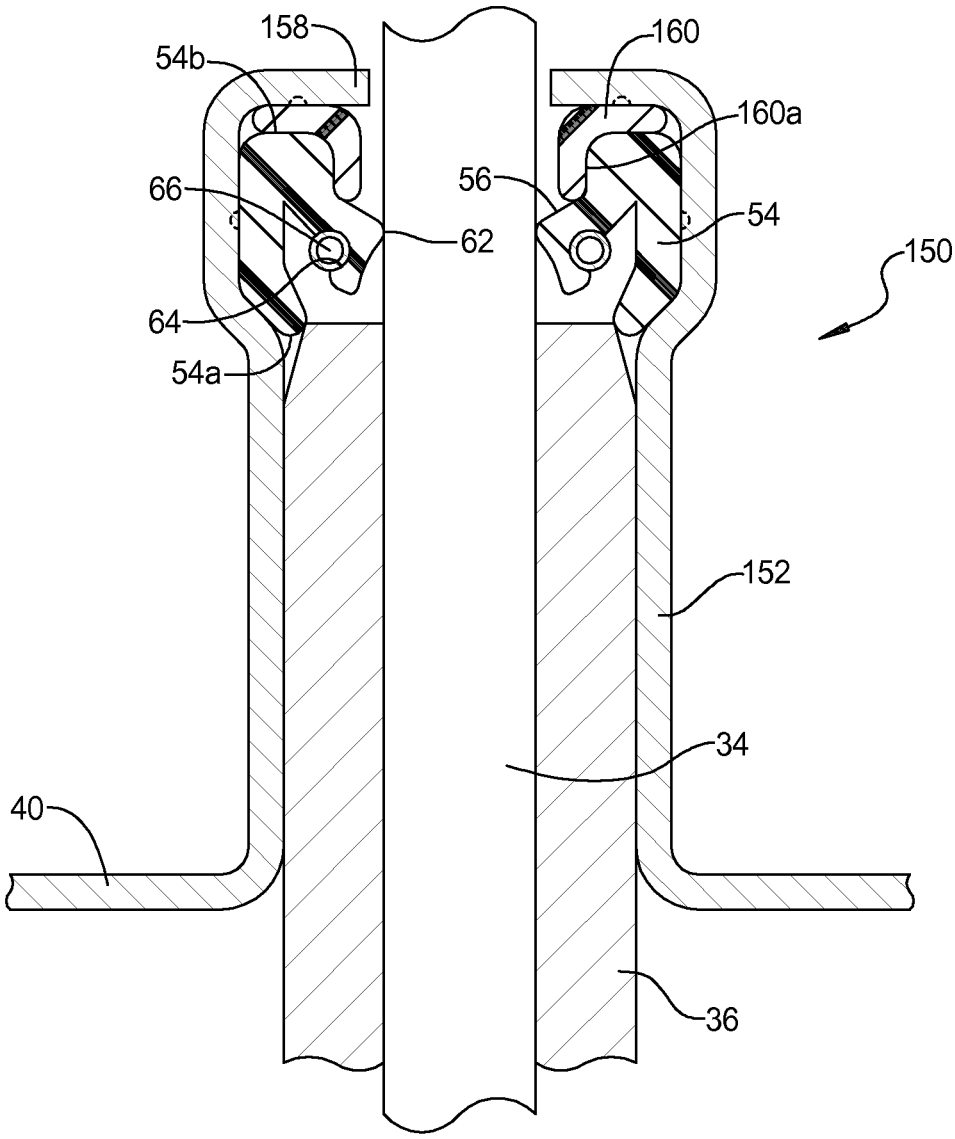
FIG. 3 is a cross-sectional view of an alternative valve stem seal assembly according to the principles of the present disclosure.

With reference to FIG. 3, an alternative valve stem seal assembly 150 according to the principles of the present disclosure will now be described. The valve stem seal assembly 150 includes an annular elastomeric body 54 includes a radially inwardly extending seal lip 56 in sealing contact with the valve stem 34 in generally the same form as described above. The annular elastomeric body 54 has a first axial end 54*a* facing the valve guide 36 and a second axial end 54*b* facing away from the valve guide 36.

The annular rigid case 152 includes a radially inwardly extending end wall 158 opposing the second axial end 54*b* of the annular elastomeric body 54. The end wall 158 of the annular rigid case 152 supports a lip support member 160 disposed between the end wall 152 and the second axial end 54*b* of the elastomeric body 54. An inner portion 160*a* of the lip support member 160 extends axially and opposes a radially inner surface 56*a* of the radially inwardly extending seal lip 56 to prevent the seal lip 56 from being inverted under high pressure.

The lip support member 160 can be made from plastic or PTFE or other rigid material.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A valve stem seal assembly for an internal combustion engine, the engine including a housing separating a lubrication chamber and a combustion chamber, a valve guide fixed in the housing, and a valve stem extending through the valve guide and housing between the lubrication chamber and the combustion chamber, the valve stem seal assembly comprising:

an annular rigid case disposed around the valve guide and the valve stem;

an annular elastomeric body press fit within said annular rigid case and including a radially inwardly extending seal lip in sealing contact with the valve stem, said annular elastomeric body having a first axial end facing the valve guide and a second axial end facing away from the valve guide, said annular rigid case including a radially inwardly extending end wall opposing said second axial end of said annular elastomeric body and including a lip support extending axially from an inner portion of said radially inwardly extending end wall toward the valve guide and opposing a radially inner surface of said radially inwardly extending seal lip.

2. The valve stem seal assembly according to claim 1, wherein said annular rigid case is made from metal.

3. The valve stem seal assembly according to claim 1, wherein said annular elastomeric body is made from rubber.

4. The valve stem seal assembly according to claim 1, wherein said radially inwardly extending seal lip includes a contact surface for engaging the valve stem and a recessed groove disposed on an opposite side of said contact surface for receiving an annular spring member therein.

5. The valve stem seal assembly according to claim 4, wherein said contact surface is axially spaced from said lip support.

6. The valve stem seal assembly according to claim 1, wherein said radially inwardly extending seal lip extends axially from said second axial end of the annular elastomeric body.

7. The valve stem seal assembly according to claim 6, wherein said radially inwardly extending seal lip includes a contact surface for engaging the valve stem and a recessed groove disposed on an opposite side of said contact surface for receiving an annular spring member therein.

8. The valve stem seal assembly according to claim 7, wherein said annular rigid case is made from metal.

9. The valve stem seal assembly according to claim 7, wherein said annular elastomeric body is made from rubber.

10. The valve stem seal assembly according to claim 9, wherein said contact surface is axially spaced from said lip support.

11. The valve stem seal assembly according to claim 7, wherein said radially inwardly extending seal lip includes a contact surface for engaging the valve stem and a recessed groove disposed on an opposite side of said contact surface for receiving an annular spring member therein.

12. The valve stem seal assembly according to claim 7, wherein said radially inwardly extending seal lip extends axially from said second axial end of the annular elastomeric body.

13. The valve stem seal assembly according to claim 12, wherein said radially inwardly extending seal lip includes a contact surface for engaging the valve stem and a recessed groove disposed on an opposite side of said contact surface for receiving an annular spring member therein.

14. A valve stem seal assembly for an internal combustion engine, the engine including a housing separating a lubrication chamber and a combustion chamber, a valve guide fixed in the housing, and a valve stem extending through the valve guide and housing between the lubrication chamber and the combustion chamber, the valve stem seal assembly comprising:

an annular rigid case disposed around the valve guide and the valve stem;

an annular elastomeric body press fit within said annular rigid case and including a radially inwardly extending seal lip in sealing contact with the valve stem, said annular elastomeric body having a first axial end facing the valve guide and a second axial end facing away from the valve guide, said annular rigid case including a radially inwardly extending end wall opposing said second axial end of said annular elastomeric body; and an annular lip support member disposed between said radially inwardly extending end wall of said annular rigid case and said second axial end of said annular elastomeric body, said annular lip support member extending toward the valve guide and opposing a radially inner surface of said radially inwardly extending seal lip.

15. The valve stem seal assembly according to claim 14, wherein said annular lip support member is made from plastic.

16. The valve stem seal assembly according to claim 14, wherein said annular lip support member is made from PTFE.

* * * * *